United States Patent [19]

Wagner et al.

[11] 4,267,899

[45] May 19, 1981

[54] MUFFLER ASSEMBLY

[75] Inventors: Wayne M. Wagner, Apple Valley; David E. Winnes, Bloomington, both of Minn.

[73] Assignee: Donaldson Company, Inc., Minneapolis, Minn.

[21] Appl. No.: 71,542

[22] Filed: Aug. 31, 1979

[51] Int. Cl.[3] ..... F01N 1/08

[52] U.S. Cl. ..... 181/272; 181/273

[58] Field of Search ..... 181/264–266, 181/268, 272, 273, 275, 276, 259, 253

[56] References Cited

U.S. PATENT DOCUMENTS

| | | | |
|---|---|---|---|
| 1,402,814 | 1/1922 | Wachtel . | |
| 1,577,626 | 3/1926 | Warth . | |
| 1,608,245 | 11/1926 | Schwager . | |
| 1,794,276 | 2/1931 | Bowes . | |
| 1,934,462 | 11/1933 | Hartsock . | |
| 1,966,620 | 7/1934 | Fluor, Jr. . | |
| 2,045,142 | 6/1936 | Horton . | |
| 2,047,443 | 7/1936 | Starkweather et al. . | |
| 2,047,775 | 7/1936 | Gunn . | |
| 2,055,453 | 9/1936 | Horton . | |
| 2,169,658 | 8/1939 | Newton . | |
| 2,189,425 | 2/1940 | Leadbetter . | |
| 2,229,576 | 1/1941 | Kirby . | |
| 2,241,010 | 5/1941 | Chipley . | |
| 2,548,563 | 4/1951 | Smith . | |
| 2,562,101 | 7/1951 | Hoyle . | |
| 2,690,812 | 10/1954 | Sparrow . | |
| 2,754,927 | 7/1956 | Kirby . | |
| 2,809,709 | 10/1957 | Billey . | |
| 2,825,421 | 3/1958 | Bryant . | |
| 2,853,367 | 9/1958 | Karol et al. . | |
| 2,937,490 | 5/1960 | Calvert . | |
| 2,940,538 | 6/1960 | Billey . | |
| 3,036,655 | 5/1962 | Powers . | |
| 3,061,416 | 10/1962 | Kazokas . | |
| 3,304,711 | 2/1967 | Eastman . | |
| 3,419,892 | 12/1968 | Wagner et al. | 181/259 X |
| 3,471,265 | 10/1969 | Ciapetta et al. . | |
| 3,557,905 | 1/1971 | Rutt . | |
| 3,583,524 | 6/1971 | Dubois . | |
| 3,589,469 | 6/1971 | Hasui et al. . | |
| 3,672,464 | 6/1972 | Rowley et al. | 181/253 |
| 4,111,279 | 9/1978 | Sterrett | 181/264 |
| 4,124,091 | 11/1978 | Mizusawa . | |
| 4,124,092 | 11/1978 | Kajiya et al. . | |
| 4,192,401 | 3/1980 | Deaver et al. | 181/266 |

FOREIGN PATENT DOCUMENTS

| | | |
|---|---|---|
| 467513 | 10/1928 | Fed. Rep. of Germany . |
| 423138 | 11/1946 | Italy . |
| 421648 | 12/1934 | United Kingdom . |

*Primary Examiner*—L. T. Hix
*Assistant Examiner*—Benjamin R. Fuller
*Attorney, Agent, or Firm*—Merchant, Gould, Smith, Edell, Welter & Schmidt

[57] ABSTRACT

A muffler (10) for reducing the noise level of gases passing therethrough is disclosed. The muffler (10) includes a housing (12) including a longitudinally extending wall (14) and a pair of opposite end walls (16, 18). Baffle plates (32, 38, 42) divide the interior space of the housing (12) into a Helmholtz resonator chamber (34), a flow chamber (36), an inlet broad band attenuator chamber (40) and an outlet broad band attenuator chamber (44). An inlet tube (20) extends through an inlet port (21) in the end wall (16), through a hole (48) in the baffle plate (38) and through a hole (50) in the baffle plate (32). An outlet tube (22) passes through an outlet port (23) in the end wall (18), through a hole (52) in the baffle plate (42) and through a hole (54) in the baffle plate (32). Exhaust gases enter the muffler (10) through the inlet tube (20), pass through holes (62) into the flow chamber (36) and exit the muffler (10) through the outlet tube (22). Broad band attenuation of noise being carried by the exhaust gases occurs in the inlet and outlet attenuation chambers (40, 44) and in a nozzle member (80). Narrow band noise attenuation occurs in the Helmholtz resonator chamber (34).

14 Claims, 4 Drawing Figures

MUFFLER ASSEMBLY

TECHNICAL FIELD

The present invention relates to mufflers for use with engines of various types. More specifically, the present invention relates to a muffler for attenuating noise generated by the engine to which the muffler is connected and which is carried to the muffler with exhaust gases from the engine.

BACKGROUND OF THE PRIOR ART

Numerous types of sound attenuating mufflers are known in the prior art. One type of muffler is a "straight through" muffler. A typical example of such a muffler is illustrated in U.S. Pat. No. 3,672,464 to Rowley et al. A convergent-divergent nozzle member is supported within a perforated outlet tube of the muffler and serves to attenuate sound generated by an internal combustion engine to which the muffler is attached.

Another type of prior art muffler is a combination muffler and air ejector unit. In such a muffler, two inlets to the muffler assembly are utilized. A first inlet communicates engine exhaust gases to the muffler and a second inlet communicates scavenged dirty air from the air cleaner during engine operation. Such a combined muffler and air ejector unit is illustrated in U.S. Pat. No. 3,419,892 to Wayne M. Wagner et al.

U.S. Pat. No. 4,111,279 to Sterrett discloses a muffler divided into a Helmholtz resonator chamber and a flow chamber. A first tube passes through the flow chamber and has an open end within the resonator chamber. Perforations or louvres through the first tube provide communication between the interior of the first tube and the flow chamber. A second imperforate tube extends through the resonator chamber and has an open end disposed within the flow chamber. Applicants have found that the use of a two-chamber system similar to the muffler system disclosed in the Sterrett patent, when constructed of a practical-size, does not exhibit sufficient sound attenuating properties. The need for mufflers with high noise attenuating capabilities has increased in recent years because of increasingly stringent governmental noise pollution regulations. For example, recent EPA regulation changes have lowered permissible sound levels on portable air compressors, which are commonly used in construction and road working applications.

SUMMARY OF THE INVENTION

The present invention is directed to a muffler for reducing the noise level of gases passing therethrough. The muffler includes a housing which defines an interior space and has an inlet and an outlet. An inlet conduit is placed in fluid communication with the inlet and extends a distance within the interior space for guiding gases to the muffler. An outlet conduit is placed in fluid communication with the outlet and extends a distance within the interior space for guiding gases out of the muffler. A partition means divides the interior space into a resonator chamber, a flow chamber, and at least one attentuator chamber. The inlet conduit has an open end disposed in the resonator chamber and a plurality of flow holes through it for providing fluid communication between the inlet and the flow chamber. The outlet conduit has an open end disposed within the flow chamber for guiding gas from the flow chamber to the outlet. At least one of the inlet and outlet conduits has a plurality of attenuation holes through it providing fluid communication to the at least one attenuation chamber so that broad band sound attenuation can occur therein.

In a preferred embodiment, the partition means includes three baffle plates which divide the interior space into the resonator chamber, the flow chamber, and a pair of broad band attenuation chambers. A first baffle plate forms a dividing wall for the resonator chamber to one of its sides and the flow chamber to its other side. A second baffle plate is located within the interior space between the first baffle plate and a first end wall. The flow chamber is formed in the interior space between the first and second baffle plates. An inlet attenuation chamber is formed in the interior space between the first baffle plate and the first end wall. A third baffle plate is supported in the interior space between the first baffle plate and a second end wall. The resonator chamber formed in the interior space between the first and third baffle plates. An outlet broad band attenuation chamber is formed between the third baffle plate and the second end wall. The inlet tube passes through aligned holes in the first and second baffle plates and the outlet tube passes through a hole in the third baffle plate and an aligned second hole in the first baffle plate. In this manner, the inlet and outlet conduits are supported in a spaced apart parallel relationship. An open end of the inlet tube is disposed within the resonator chamber and an open end of the outlet tube is disposed within the flow chamber. Exhaust gas flowing through the muffler passes from the inlet tube through the flow holes into the flow chamber, and thereafter passes out of the muffler through the outlet tube. Sound attenuation of noise being carried with the exhaust gas occurs in the two broad band attenuation chambers and within the resonator chamber. A convergent-divergent nozzle member may be supported within the outlet tube to provide further broad band sound attenuation.

Various advantages and features of novelty which characterize the invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
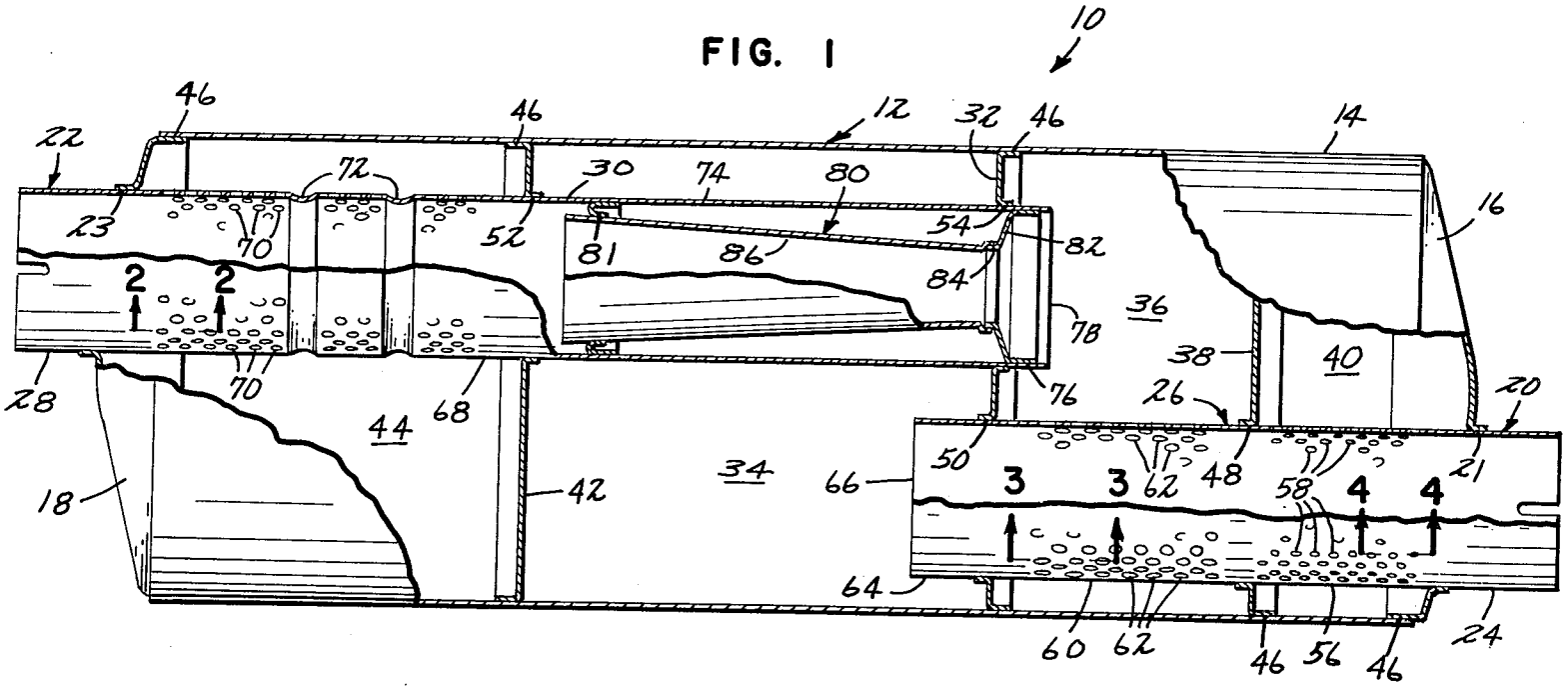
FIG. 1 is an elevational view, partially broken away and in section, illustrating a muffler in accordance with the present invention.

Referring to the drawings in detail wherein like numerals indicate like elements, there is shown in FIG. 1 a muffler in accordance with the present invention, designated generally as 10. The muffler 10 includes a housing 12 which is comprised of a longitudinally extending wall 14, a first end wall 16 secured to a first end of the wall 14, and a second end wall 18 secured to an opposite longitudinal end of the wall 14. The wall 14 is shown as curvilinear in shape and may be either round or oval. However, a rectilinear configuration, wherein a plurality of flat longitudinally extending walls are interconnected, could also be used.

An inlet tube 20 extends through an inlet port or hole 21 in the end wall 16 longitudually inward into the interior space of the housing 12. An outlet tube 22 extends through an outlet port or hole 23 in the end wall 18 longitudinally inward into the interior space of the housing 12. The inlet tube 20 has a first section 24 which is disposed outside the housing 12 and a second section 26 which is disposed within the interior space bounded by the housing 12. Similarly, the outlet tube 22 has a first section 28 disposed outside the housing 12 and a second section 30 disposed within the interior space bounded by the housing 12.

A first baffle plate 32 is supported within the housing 12 and forms a dividing wall for a Helmholtz resonator chamber 34 to one of its sides and a flow chamber 36 to its other side. A second baffle plate 38 is supported in the housing 12 intermediate the first baffle plate 32 and the end wall 16. A flow chamber 36 is formed between the first and second baffle plates 32, 38. An inlet attenuator chamber 40 is formed between the second baffle plate 38 and the end wall 16. A third baffle plate 42 is supported within the interior space of the housing 12 at a location intermediate the first baffle plate 32 and the end wall 18. The Helmholtz resonator chamber 34 is thus formed between the first and third baffle plates 32, 42. An outlet attenuator chamber 44 is formed between the third baffle plate 42 and the end wall 18.

The end walls 16, 18 and the baffle plates 32, 38 and 42 are each preferably made of a single integral piece of material, and each has a mounting flange or lip 46 extending about its periphery. Each flange 46 is attached to an interior surface of the wall 14. The walls 14, 16, 18 and baffle plates 32, 38, and 42 are all preferably made of heavy-duty metal and the flanges 46 are fixed to the interior surface of the wall 14 by spot welding. The second section 26 of the inlet tube 20 extends through a hole 48 formed through the baffle plate 38 and a hole 50 through the baffle plate 32. The second section 30 of the tube 22 extends through a hole 52 through the baffle plate 42 and through a second hole 54 through the baffle plate 32. The port 23 and holes 52, 54 are aligned with one another. The port 21 and the holes 48, 50 are aligned with one another. In this manner, the inlet tube 20 and the outlet tube 22 are held in a generally parallel spaced apart relationship.

A portion 56 of the inlet tube 20 is disposed within the inlet attentuator chamber 40. The portion 56 has a plurality of perforations or holes 58 formed through it. A portion 60 of the inlet tube 20 is disposed within the flow chamber 36 and has a plurality of perforations or holes 62 formed through it. A portion 64 of the tube 20 is disposed within the resonator chamber 34 and has an open end 66. Except for the opening 66, the resonator chamber 34 is completely sealed or enclosed and, hence, acts as a Helmholtz resonator for narrow band sound attenuation. The outlet tube 22 has a portion 68 which is disposed in the outlet attenuator chamber 44. The portion 68 has a plurality of perforations or holes 70 formed through it and a pair of antiwhistle beads or indentations 72. The tube 22 has a portion 74 which is disposed within the resonator chamber 34. A portion 76 of the tube 22 is disposed within the flow chamber 36 and has an open end 78 therein. A convergent-divergent nozzle member 80 is supported within the portion 74 of the tube 22. An annular support member 81 holds an outlet end of the member 80 in the outlet tube 22. The nozzle member 80 serves as a noise attenuating means. The nozzle 80 has an abruptly tapering converging inlet portion 82, a throat 84, and a diverging portion 86. For a fuller discussion of the structure and function of the nozzle member 80, reference is made to U.S. Pat. No. 3,672,464, the disclosure of which is incorporated herein.

Figure 4:
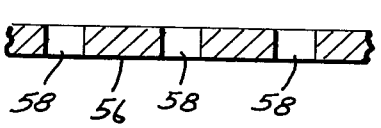
FIG. 4 is a sectional view on an enlarged scale taken generally along line 4—4 of FIG. 1.
Figure 3:
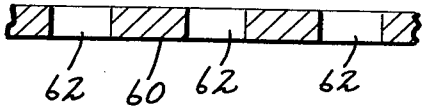
FIG. 3 is a sectional view on an enlarged scale taken generally along line 3—3 of FIG. 1.
Figure 2:
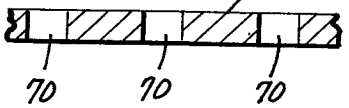
FIG. 2 is a sectional view on an enlarged scale taken generally along line 2—2 of FIG. 1.

As is best seen in FIGS. 2–4, the size of the holes 58 and 70 is approximately the same, while the size of the holes 62 is larger than the holes 58 and 70. To attain satisfactory sound attenuation, the holes 58 open approximately 5 to 30 percent of the surface area of the portion 56 to the chamber 40, and the holes 70 open approximately 5 to 30 percent of the surface area of the portion 68 to the attenuator chamber 44. Also, approximately 5 to 30 percent of the surface area of the portion 60 is open to the flow chamber 36 by means of the holes 62. In an exemplary muffler 10, the inlet tube 20 may have a diameter of four or five inches and the outlet tube 22 may have a diameter of five inches. Within such a muffler 10, the holes 58, 70 would preferably be ⅛ inch in diameter and the holes 62 would be approximately 3/16 inch in diameter.

The muffler 10 operates in the following manner. Exhaust gases and noise sound waves carried therewith enter the muffler 10 through the inlet tube 20. The flow path of gases is through the interior of the inlet tube 20, through the perforations or holes 62 and into the flow chamber 36. Thereafter, the exhaust gases flow into the outlet tube 22 and out of the muffler 10. During the passage of the exhaust gases through the muffler 10, sound attenuation occurs in several discrete areas of the muffler 10. The perforations or holes 58 provide fluid continuity between the interior of the inlet tube 20 and the inlet attenuation chamber 40. The chamber 40 serves as a broad band attenuator to attenuate sound waves over a relatively broad frequency band. The chamber 34 serves as a Helmholtz resonator chamber and is tuned to attenuate sound waves primarily at a chosen frequency, typically a low frequency. The selected frequency is generally a strong or objectionable frequency produced by the engine or machine to which the muffler 10 is attached. Broad band attenuation of sound waves is also accomplished by the passage of the gas and sound waves through the nozzle member 80. Finally, broad band sound attenuation also occurs in the outlet attenuator chamber 44 which is placed in fluid continuity with the interior of the outlet tube 22 by the perforations or holes 70.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent extended by the broad general meaning of the terms in which the appended claims are expressed.

What is claimed is:

1. A muffler for reducing the noise level of gases passing therethrough comprising:

a housing defining an interior space and having an inlet and an outlet;

an inlet conduit in fluid communication with said inlet and extending a distance within said interior space for guiding gases to the muffler;

an outlet conduit in fluid communication with said outlet and extending a distance within said interior space for guiding gases out of the muffler;

partition means for dividing said interior space into a plurality of chambers including a resonator chamber, a flow chamber, and a broad band attenuation chamber;

said inlet conduit having an open end disposed within said resonator chamber and a plurality of flow holes through it for providing fluid communication between said inlet and said flow chamber;

said outlet conduit having an open end disposed within said flow chamber for guiding gas from said flow chamber to said outlet; and one of said inlet and outlet conduits passing through said attenuation chamber and having a field of attenuation holes through it for providing fluid continuity to said attentuation chamber so that broad band sound attenuation can occur therein.

2. A muffler in accordance with claim 1 wherein said partition means defines a first and a second of said attenuation chambers, said inlet conduit having a plurality of attenuation holes through it for providing fluid continuity between said inlet conduit and said first attenuation chamber, and said outlet conduit having a plurality of attenuation holes through it for providing fluid continuity between said outlet conduit and said second attenuation chamber.

3. A muffler for reducing the noise level of gases passing therethrough comprising:

a housing defining an interior space and having an inlet and an outlet;

an inlet conduit in fluid communication with said inlet and extending a distance within said interior space for guiding gases to the muffler;

an outlet conduit in fluid communication with said outlet and extending a distance within said interior space for guiding gases out of the muffler; and partition means for dividing said interior space into a resonator chamber, a flow chamber, and first and second broad band attenuation chambers;

said inlet conduit having an open end disposed within said resonator chamber and a plurality of flow holes through it for providing fluid communication between said inlet and said flow chamber;

said outlet conduit having an open end disposed within said flow chamber for guiding gas from said flow chamber to said outlet;

said inlet conduit having a field of attenuation holes through it for providing fluid continuity with one of said attenuation chambers, and said outlet conduit having a field of attenuation holes through it for providing fluid continuity with the other of said attenuation chambers, so that broad band sound attenuation can occur therein, each of the attenuation holes through said inlet and outlet conduits having a transverse dimension less than each of the flow holes through said inlet conduit.

4. A muffler in accordance with claim 3 wherein the flow holes through said inlet conduit open between five and thirty percent of the surface area of the portion of said inlet conduit disposed in said flow chamber.

5. A muffler in accordance with claim 2 wherein the attenuation holes through said inlet conduit open between 5 and 30 percent of the surface area of the portion of said inlet conduit disposed in said first attenuation chamber, and the attenuation holes through said outlet conduit open between 5 and 30 percent of the surface area of the portion of said outlet conduit disposed in said second attenuation chamber.

6. A muffler for reducing the noise level of gases passing therethrough comprising:

a housing having a longitudinal dimension extending between opposite longitudinal ends with an end wall at each longitudinal end, said housing defining an interior space;

an inlet port formed through a first of said end walls and an outlet port formed through a second of said end walls;

an inlet tube connected to said first wall in fluid communication with said inlet port for guiding gases to said muffler, said inlet tube extending from said first end wall longitudinally inward into said interior space and having an open end within said interior space;

an outlet tube connected to said second end wall in fluid communication with said outlet port for guiding gases out of said muffler, said outlet tube extending from said second end wall longitudinally inward into said interior space and having an open end within said interior space;

a first baffle plate supported within said housing for dividing said interior space into a Helmholtz resonator chamber on one side of said plate and a flow chamber on the other side of said plate for passing gas from said inlet tube to said outlet tube, said inlet tube extending from said inlet port through said flow chamber and to said resonator chamber;

at least a second baffle plate supported within said housing at a location intermediate said first baffle plate and one of said first and second end walls to define an attenuation chamber within said interior space between said last-mentioned end wall and said second baffle plate, one of said inlet and outlet tubes extending from a respective end wall through said attenuation chamber;

said open end of said inlet tube being disposed in said Helmholtz resonator chamber, said open end of said outlet tube being disposed in said flow chamber, a portion of said inlet tube having flow holes through it for passing incoming gas to said flow chamber, and a portion of one of said inlet and outlet tubes which extends through said attenuation chamber having a plurality of attenuation holes through it for providing fluid communication to said attenuation chamber whereby noise being carried with the gas passing through said muffler is attenuated in both said Helmholtz resonator chamber and said attenuator chamber.

7. A muffler in accordance with claim 6 including an attenuator means supported in said outlet tube for attenuating noise carried with the gas passing through said outlet tube.

8. A muffler in accordance with claim 7 wherein said attenuator means includes an inperforate nozzle member disposed in said outlet tube, said nozzle member having a mouth disposed adjacent the open end of said outlet tube disposed in said flow chamber, said nozzle member having a portion converging from its mouth to a throat and a portion diverging from the throat in a direction toward the outlet port.

9. A muffler in accordance with claim 6, 7 or 8 including a third of said baffle plates supported in said housing, said second baffle plate being supported at a location intermediate said first baffle plate and said first end wall to define an inlet attenuation chamber within said interior space between said first end wall and said second baffle plate, said third baffle plate being supported within said housing at a location intermediate said first baffle plate and said second end wall to define an attenuation chamber within said interior space between said second end wall and said third baffle plate.

10. A muffler in accordance with claim 9 wherein each baffle plate is formed of a single integral piece of material having an outer perimeter attached to an inner surface of said housing, said first and second baffle plates each having a hole aligned with one another for holding said inlet tube within said interior space, said third baffle plate having a hole aligned with a second hole in said first baffle plate for supporting said outlet tube within said interior space.

11. A muffler in accordance with claim 9 wherein the holes through said inlet and outlet tubes for providing communication with said inlet and outlet attenuation chambers each have transverse dimensions approximately the same, and the transverse dimension of the holes in said inlet tube for providing communication to said flow chamber have a transverse dimension larger than the transverse dimension of the holes providing communication to said inlet and outlet attenuation chambers.

12. A muffler in accordance with claim 9 wherein the holes in said inlet tube for providing communication to said inlet attenuation chamber open between 5 and 30 percent of the surface area of the portion of said inlet tube disposed in said inlet attenuation chamber, the holes in said inlet tube for providing communication to said flow chamber open between 5 and 30 percent of the surface area of the portion of said inlet tube disposed in said flow chamber, and the holes in said outlet tube for providing communication to said outlet attenuation chamber open between 5 and 30 percent of the surface area of the portion of said outlet tube disposed in said outlet attenuation chamber.

13. A muffler for reducing the noise level of gases passing therethrough, comprising:

a housing having a longitudinal dimension extending between opposite longitudinal ends with an end wall at each longitudinal end, said housing defining an interior space;

an inlet port formed through a first of said end walls and an outlet port formed through a second of said end walls;

a first baffle plate supported in said housing and extending generally perpendicular to the longitudinal dimension;

a second baffle plate supported within said housing at a location intermediate said first baffle plate and said first end wall, said second baffle plate extending generally perpendicular to said longitudinal dimension;

a third baffle plate supported in said housing at a location intermediate said first baffle plate and said second end wall, said third baffle extending generally perpendicular to said longitudinal dimension;

said first and second baffle plates each having a hole aligned with said inlet port, and said first baffle plate having a second hole aligned with a hole through said third baffle and said outlet port;

an inlet tube extending through and supported by said inlet port, said hole through said second baffle plate and said first hole through said first baffle plate;

an outlet tube extending through and supported by said outlet port, said hole through said third baffle plate and said second hole through said first baffle plate;

a broad band attenuation chamber being formed within said interior space between said second baffle plate and said first end wall and surrounding said inlet tube;

a plurality of first attenuation holes formed through said inlet tube in the portion of said inlet tube disposed within said inlet attenuation chamber whereby broad band attenuation of noise being carried with gases passing through said muffler can occur in said inlet attenuation chamber;

a flow chamber being defined within said interior space between said first baffle plate and said second baffle plate for communicating gases from said inlet tube to said outlet tube, said inlet tube having a plurality of flow holes formed through it for passing gas from the interior of said inlet tube to said flow chamber, said outlet tube having an open end disposed in said flow chamber for receiving exhaust gases passing therefrom;

a Helmholtz resonator chamber being formed in the interior space between said second and third baffle plates, said inlet tube having an open end disposed in said Helmholtz resonator chamber whereby narrow band noise attenuation can occur therein;

an outlet attenuation chamber being formed in the interior space between said third baffle plate and said second end wall, a plurality of attenuation holes being formed through a portion of said outlet tube disposed in said outlet attenuation chamber whereby broad band noise attenuation can occur therein; and a convergent-divergent nozzle member supported in said outlet tube for causing broad band sound attenuation therein.

14. A muffler for reducing the noise level of gases passing therethrough comprising:

a housing defining an interior space and having an inlet and outlet;

an inlet conduit in fluid communication with said inlet and extending a distance within said interior space for guiding gases to the muffler;

an outlet conduit in fluid communication with said outlet and extending a distance within said interior space for guiding gases out of the muffler; and partition means for dividing said interior space into a resonator chamber, a flow chamber, and first and second attenuation chambers;

said inlet conduit having an open end disposed within said resonator chamber and a plurality of flow holes through it for providing fluid communication between said inlet and said flow chamber;

said outlet conduit having an open end disposed withing said flow chamber for guiding gas from said flow chamber to said outlet; and said inlet conduit having a field of attenuation holes through it for providing fluid continuity with one of said attenuation chambers and said outlet conduit having a field of attentuation holes through it for providing fluid continuity with the other of said attenuation chambers, so that broad band sound attenuation can occur therein, the flow holes through said inlet conduit opening between five and thirty percent of the surface area of the portion of said inlet conduit disposed in said flow chamber.

* * * * *